US005441018A

United States Patent [19]

Almassi

[11] Patent Number: 5,441,018

[45] Date of Patent: Aug. 15, 1995

[54] INTERNAL COMBUSTION ROTARY PISTON ENGINE

[76] Inventor: Mansour Almassi, 7 Hope Street, Ardross, Australia, 6153

[21] Appl. No.: 211,780

[22] PCT Filed: Oct. 14, 1992

[86] PCT No.: PCT/AU92/00545

§ 371 Date: Apr. 14, 1994

§ 102(e) Date: Apr. 14, 1994

[87] PCT Pub. No.: WO93/08372

PCT Pub. Date: Apr. 29, 1993

[30] Foreign Application Priority Data

Oct. 15, 1991 [AU] Australia ..... PK8917

[51] Int. Cl.[6] ..... F02B 75/26; F02B 75/28

[52] U.S. Cl. ..... 123/45 A; 123/55.7

[58] Field of Search ..... 123/45 R, 45 A, 43 AA, 123/56.2, 55.7

[56] References Cited

U.S. PATENT DOCUMENTS

| | | | |
|---|---|---|---|
| 2,352,396 | 6/1944 | Maltby . | |
| 2,532,106 | 11/1950 | Korsgren . | |
| 3,757,748 | 9/1973 | Arney | 123/45 A |
| 4,157,079 | 6/1979 | Kristiansen | 123/43 AA |
| 4,180,028 | 12/1979 | Richter | 123/45 A |
| 4,974,556 | 12/1990 | Royse . | |
| 5,133,305 | 7/1992 | Tanigawa et al. | 123/45 A |
| 5,152,257 | 10/1992 | Blount | 123/45 A |

FOREIGN PATENT DOCUMENTS

| | | | |
|---|---|---|---|
| 29904 | 3/1931 | Australia . | |
| 0240467 | 4/1987 | European Pat. Off. . | |
| 357291 | 3/1990 | European Pat. Off. | 123/56.2 |
| 472564 | 3/1929 | Germany . | |
| 504514 | 8/1930 | Germany . | |
| 3831451 | 4/1990 | Germany . | |
| 53851 | 2/1920 | Sweden | 123/43 AA |
| 425112 | 3/1935 | United Kingdom | 123/56.2 |
| 1563498 | 3/1980 | United Kingdom . | |
| 2198788 | 6/1988 | United Kingdom . | |
| 2226612 | 7/1990 | United Kingdom . | |
| 2226710 | 7/1990 | United Kingdom . | |
| 87/02416 | 4/1987 | WIPO . | |
| 90/12952 | 11/1990 | WIPO . | |

*Primary Examiner*—Michael Koczo

*Attorney, Agent, or Firm*—Killworth, Gottman, Hagan & Schaeff

[57] ABSTRACT

A two stroke engine (2) comprises a housing (4), a cylinder (6), a shaft (10) rotatably supported in the housing (4) for rotation about the cylinder axis (14), a piston (8) slidably mounted on the shaft (10) while fixed for rotation with the shaft (10) and co-operating slidably with cylinder (6), a pair of sinusoidal tracks (16) and track engaging elements (18) arranged respectively on the piston (8) and on the housing (4) to relatively rotate the piston (8) about the cylinder axis (14) while undergoing reciprocation in the cylinder (6) to impart rotation to the shaft (10). Additionally, scavenging means for the engine (2) is provided by the piston (8) having a first piston head portion (24) and a second piston head portion (26) connected by a sleeve portion (28) for combined reciprocation in the respective cylinder portions (20) and (40) to supply compressed scavenging fluid and compressed combustion fluid from cylinder portion (40) to cylinder portion (20) where combustion takes place.

30 Claims, 7 Drawing Sheets

INTERNAL COMBUSTION ROTARY PISTON ENGINE

FIELD OF THE INVENTION

The invention relates to an internal combustion rotary piston engine, and in particular, but not exclusively to a two stroke internal combustion rotary piston engine.

BACKGROUND OF THE INVENTION

In the operation of an internal combustion engine, there are four steps that must take place: fuel and air must be introduced into a cylinder, the mixture must be compressed, it must then be burnt, and the exhaust gasses must be removed from the cylinder before introducing a fresh charge of fuel and air. In diesel engines, the fuel and air do not enter the cylinder at the same time, but the cycle of operation is nevertheless the same. There are two basic systems of accomplishing these operations, the four stroke cycle, in which one operation takes place during each passage of the piston up or down the cylinder, and the two stroke cycle in which two of the operations are accomplished in each passage of the piston.

In a four stroke cycle, the four mentioned steps require two complete reciprocations of the piston or two revolutions of an associated crank shaft. A fly wheel stores sufficient energy from a power stroke to carry the piston through the next three strokes before the next power stroke. In a two stroke cycle, a first charge of fuel and air is compressed below the piston or by some other means and then forced into the cylinder when the piston is at the bottom of its stroke; the charge is then compressed by the pistons upward motion, and ignited at the end of its compression stroke. At the end of the power stroke, a fresh charge sweeps the exhaust gasses out of the cylinder. However some of this charge is lost through the exhaust port during this sweeping. Accordingly, there is one power stroke for each reciprocation of the piston or revolution of an associated crank shaft.

The advantages of a two stroke engine over a four stroke engine are that it provides more frequent power strokes and has greater mechanical simplicity and lightness. These advantages are to some extent offset by the fact that the two stroke engine wastes a large portion of the charge of fuel and air admitted into the cylinder. If the charge is of the same size as would be required by a comparable four stroke engine, the two stroke engine would not sweep out exhaust gasses completely, thereby cutting down on the power developed on the next stroke since a percentage of the charge includes burnt gases from the previous cycle. In addition the power stroke is shorter, since the exhaust gasses are expelled during part of the down stroke. A further disadvantage of the two stroke engine is that of lubrication. In a four stroke engine, oil stored in a crank case splashes up onto the cylinder walls to lubricate the piston. However such a system cannot be used in two stroke engines as oil splashed onto the cylinder would be carried out with the exhaust gasses eventually leaving the piston unlubricated. This is overcome by mixing lubricating oil with the fuel. However, this leads to smoky exhaust fumes and fouling of the engine by partially burnt oil.

For the above reasons, the two stroke cycle is preferred for small engines where lightness and simplicity are more important than the problems of highly polluted exhaust and the necessity of mixing lubricating oil with fuel, for example engines for lawn mowers, motor cycles, and tools such as chain saws and brush cutters. The four. Stroke cycle is favoured for higher powered engines, for example, in motor vehicles and boats where several pistons are attached to a crank shaft providing more power strokes per turn.

SUMMARY OF THE INVENTION

It is an object of the present invention to provide an internal combustion engine which attempts to alleviate at least one of the disadvantages in the above described prior art.

According to the present invention there is provided an internal combustion rotary piston engine comprising:

a housing defining a cylinder;

a shaft supported coaxially in said cylinder for rotation about a longitudinal axis of said shaft;

a piston mounted for reciprocation in said cylinder and arranged to slidably move along a length of the shaft during an operating cycle of said engine, said operating cycle comprising a power stroke in which said piston slides in one direction along said shaft and during which a fuel is combusted, and a return stroke in which said piston slides in an opposite direction along said shaft and during which combusted fuel is exhausted; and, means for constraining said piston to rotate about said axis during said sliding movement along said shaft and wherein said shaft is adapted to rotate with said piston about said axis;

wherein during said power stroke said piston rotates about said axis by an angle X°, where X° is greater than 180° and less then 360° and during said return stroke said piston rotates through an angle Y°, where Y° equals 360° minus X°, whereby, in use, during said power stroke said piston imparts torque to said shaft.

Preferably said cylinder comprises first and second chambers and said piston, during one complete cycle of reciprocation of said piston, operates to sequentially induct a cleaning fluid into said second chamber and compress said cleaning fluid for purging said first chamber.

Preferably during said cycle said piston also operates to sequentially induct a combustion fluid into said second chamber and compress said combustion fluid for combustion in said first chamber.

Preferably said piston comprises a first head for reciprocation in said first chamber and a second head for reciprocation in said second chamber, said second head operable to induct said cleaning fluid and said combustion fluid into said second chamber.

Preferably, said cleaning fluid and said combustion fluid are inducted into said second chamber on opposite sides of said second head.

Preferably said second head comprises a storage chamber for storing a volume of compressed cleaning fluid during a portion of said cycle.

Preferably said storage chamber includes a first valve for allowing ingress of the cleaning fluid as said second head compresses said cleaning fluid, and a second valve for allowing egress of said compressed fluid.

Preferably said second valve comprises a first passage formed in said storage chamber and opening onto a circumferential surface of said cylinder, and a second passage formed in said housing and communicating with said first chamber, wherein, said first and second passages are arranged to register with each other for a first predetermined period in said cycle.

Preferably said engine includes a third valve comprising a third passage communicating between said second passage and said first chamber, said third passage opening onto a circumferential-wall of said cylinder and said first head, wherein said first head is arranged to open said third passage during said first predetermined period and to seal said third passage during the remaining period of said cycle.

Preferably said first head is provided with a first cut-out extending between a circumferential surface of the first head and a top surface of said first head, wherein, said first cut-out is arranged to register with said third passage during said first predetermined period to allow said compressed cleaning fluid to flow into said first chamber.

Preferably delivery of said compressed combustion fluid from said second chamber to said first chamber is effected by a fourth valve comprising a fourth passage formed in said cylinder communicating between said first and second chambers and said first piston head, wherein, said first piston head is arranged to open said third passage during a second predetermined period of said cycle occurring after the first period of said cycle and to seal said fourth passage during the remaining period of said cycle.

Preferably said first head is provided with a second cut-out extending between said circumferential surface and said top surface of the first head and circumferentially spaced from said first cut-out, wherein, said second cut-out is arranged to register with said fourth passage during said second period in said cycle.

Preferably X is greater than or equal to 270° and less than 360°.

Preferably X is in the order of 270°.

Preferably said constraining means comprises an endless track provided on one of said piston and said cylinder extending about said axis, and an element mounted on the other of said piston and said cylinder for engaging said track.

Preferably said element comprises a bearing received within said track for rolling contact with said track.

Preferably said internal combustion engine further comprises a second piston slidably mounted on said shaft and fixed for rotation with said shaft about said axis, wherein, said pistons are arranged to slide along said shaft in mutually opposite directions and to rotate in the same direction during a cycle of reciprocation of said engine.

Preferably said cylinder comprises a third chamber and said second piston comprises a first head for reciprocation in said third chamber and wherein said first and second pistons reciprocate in synchronism.

Preferably the displacement of said second and third chambers is greater than that of the first chamber.

Preferably said shaft includes an axial passage for flow of a lubricating fluid therethrough for lubrication and cooling of said engine.

BRIEF DESCRIPTION OF THE DRAWINGS

An embodiment of the invention will now be described by way of example only, with reference to the accompanying drawings in which.

DETAILED DESCRIPTION OF PREFERRED EMBODIMENTS

Figure 1:
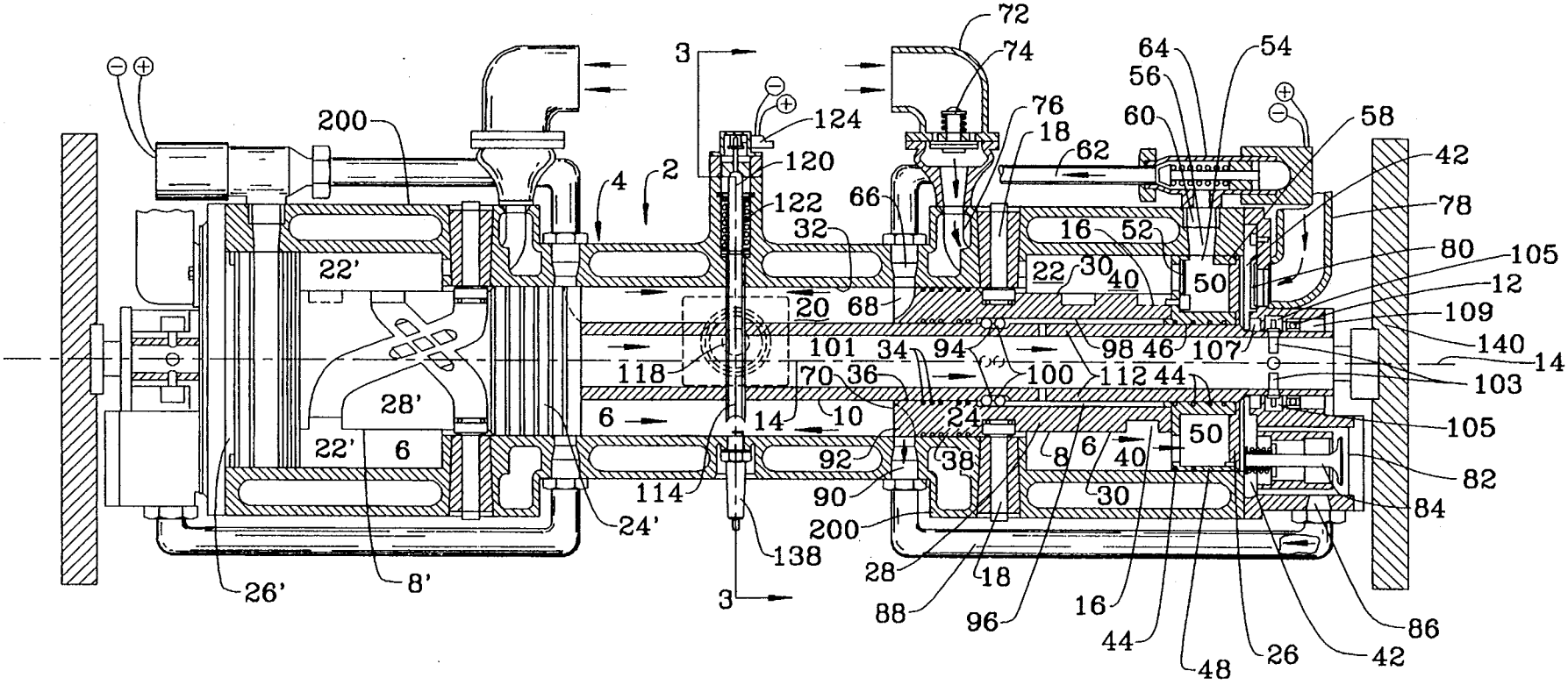
FIG. 1 is a sectional view of a first embodiment of the internal combustion rotary piston engine at the end of a first stroke.
Figure 2:
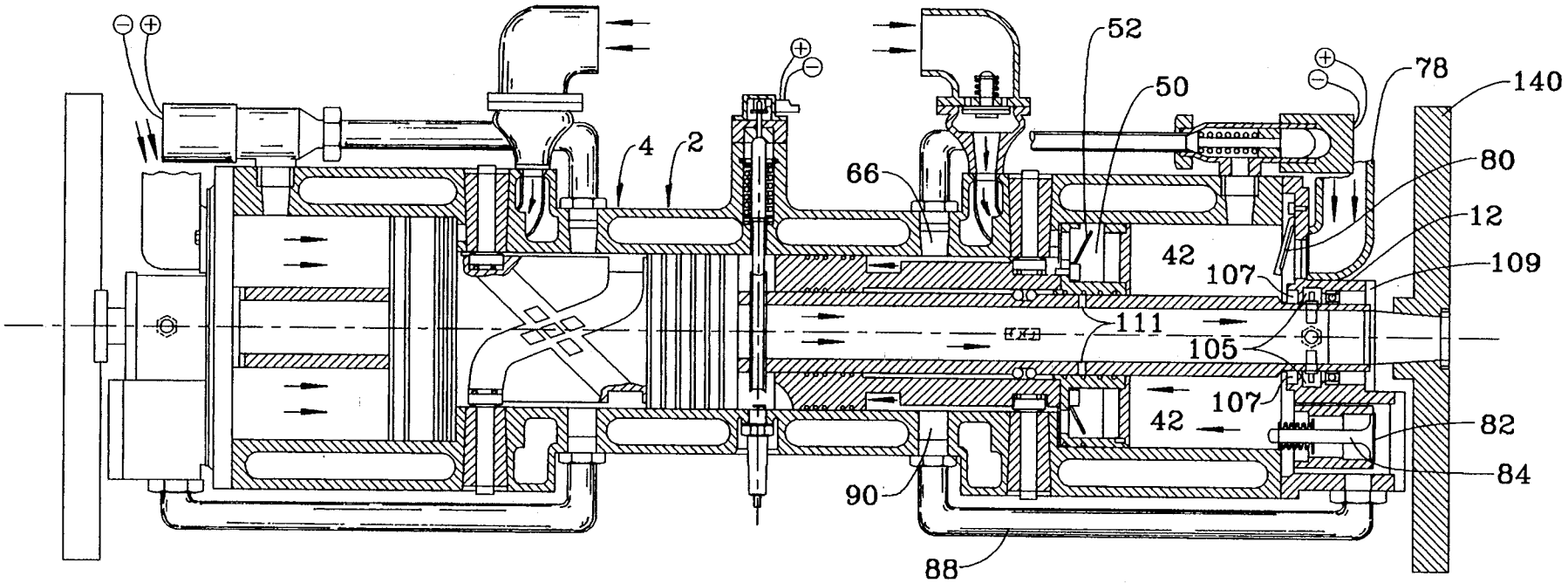
FIG. 2 is a sectional view of the internal combustion rotary piston engine illustrated in FIG. 1, with the engine shown at the end of a second stroke.

Referring to the accompanying drawings, in particular FIGS. 1 and 2, it can be seen that the internal combustion engine 2 comprises a housing 4 defining a cylinder 6. A first piston 8 is mounted for reciprocation in the cylinder 6. A shaft 10 is supported co-axially in the cylinder 6 by bearings 12 for rotation about a longitudinal axis 14 of the shaft 10. The first piston 8 is slidably mounted on the shaft 10 and fixed for rotation with the shaft 10 about the axis 14. Also included is means, in the form of endless tracks 16 (refer FIG. 4) formed in piston 8 and track engaging elements 18, for constraining the piston 8 to rotate about the axis 14 as it slides along the shaft 10, so that, in use, reciprocation of the piston 8 imparts torque to the shaft 10.

The cylinder 6 includes integral first and second chambers 20, 22. The piston 8 comprises first and second heads 24 and 26 respectively which are spaced by a skirt 28 depending from the first head 24. The endless tracks 16 is formed as a channels on a surface 30 of the skirt 28 adjacent the circumferential surface 32 of the cylinder 6. The first head 24 reciprocates in first chamber 20 and effectively seals the first chamber 20 from the second chamber 22. The sealing is achieved by way of conventional piston rings 34 residing in circular grooves formed in both inner and outer circumferential surfaces 36, 38 respectively of the first head 24.

The second head 26 reciprocates in the second chamber 22 and divides the second chamber 22 into sub spaces 40 and 42. The sub spaces 40 and 42 have respective volumes which vary in accordance with the position of the second head 26 within the second chamber 22. Piston rings 44 which reside in circular grooves formed in the inner and outer circumferential surfaces 46 and 48 respectively of the second head 26 effectively seal the first subspace 40 and the second subspace 42.

The second head 26 includes a storage chamber 50 for storing a volume of compressed cleaning gas in the form of compressed air during a portion of a cycle of reciprocation of the engine, as will be described hereinafter. The storage chamber 50 is provided with a one way valve 52 which operates to allow the ingress of air into the storage chamber 50 during a return stroke of the piston 8 but prevents the escape of air during a power stroke of the piston 8.

A second valve 54 is provided to allow the egress of compressed air from the storage chamber 50 during a subsequent portion of the cycle of the engine. The second valve 54 includes a passageway 56 formed in a circumferential wall 58 of the second head 26, and a further passageway 60 formed in the housing 4. Passageway 60 communicates with the first chamber 20 via a conduit 62. A solenoid valve 64 is selectively operated to open or close the conduit 62 for communication with the passageway 60. The passageways 56 and 60 are arranged to register with each other during a predetermined period of the cycle of the engine. During this time compressed air within the storage chamber 50 can flow into the conduit 62 provided it is opened by the solenoid valve 64.

An end of the conduit 62 opposite the solenoid valve 64 is connected to the housing 4 and communicates, via a passageway 66 formed in housing 4, with the first chamber 20. The passageway 66 is selectively opened and closed by the outer circumferential surface 38 of the first head 24 which operates as a rotary valve. Specifically, the first head 24 is provided with a cut-out 68 extending between the circumferential surface 38 and a top surface 70 of the first head 24. The cut out 68 is arranged to register with the passageway 66 at substantially the same time as passageway 56 registers with passageway 60 and solenoid valve 64 opens conduit 62. This allows compressed air in the storage chamber 50 to flow into the first chamber 20.

Fresh air is supplied to the second chamber 22 via an air intake manifold 72 which communicates via a one way valve 74 with an air intake conduit 76 which in turn opens into the sub space 40 of the second chamber 22.

A combustion fluid, in the form of a fuel and fresh air mixture, is supplied to the subspace 42 through a manifold 78 which is opened and closed by a one way valve 80. When the piston 6 is travelling in its return stroke (as illustrated in FIG. 2) a partial vacuum is created in the sub space 42 forming a pressure differential across, and subsequent opening, the one way valve 80. This in turn allows the fuel and air mixture to enter the sub space 42. During this part of the cycle of the engine the solenoid valve 64 is operated to close conduit 62 thereby preventing any significant loss of fuel air mixture through the passageway 60.

The term "combustion fluid" is used in general to denote any fluid which is either combustible or aids in the combustion of a combustible fluid, for example, petrol, diesel, alcohol, oxidant, air or a mixture thereof.

The sub space 42 is provided with an outlet 82 which is opened and closed by a spring valve 84. The outlet 82 communicates, via a passageway 86 formed in the housing 4, with one end of a conduit 88. The opposite end of conduit 88 leads into a passageway 90 formed in the housing 4 that communicates with the first chamber 20. The passageway 90 is opened and closed by the first head 24 which operates as a rotary valve. In particular, the first head 24 is provided with a second cut-out 92 (shown in phantom) that extends between the top surface 70 and peripheral surface 38 of the first head 24. The cut-out 92 is arranged to register with the passageway 90 at the same time as spring operated valve 84 is opened so that fuel and air mixture in the sub space 42 can flow into the first chamber 20.

The volume or displacement of the second chamber 22 is equal to or preferably greater than that of the first chamber 20. Accordingly, air or the fuel and air mixture when transferred from chamber 22 remains under greater pressure than atmospheric pressure.

Circumferentially spaced about the shaft 10 are four recesses 94. Four longitudinal slots 96 are also formed about an inner circumferential surface 98 of the skirt 28. As more clearly seen in FIG. 3, the shaft 10 and piston 6 are mechanically coupled by pairs of ball bearings 100 which are accommodated between corresponding recesses 94 and slots 96. This coupling arrangement allows the piston 8 to slide axially along the shaft 10 while simultaneously fixing or locking the piston 8 for rotation with the shaft 10 about the longitudinal axis 14.

Figure 4:
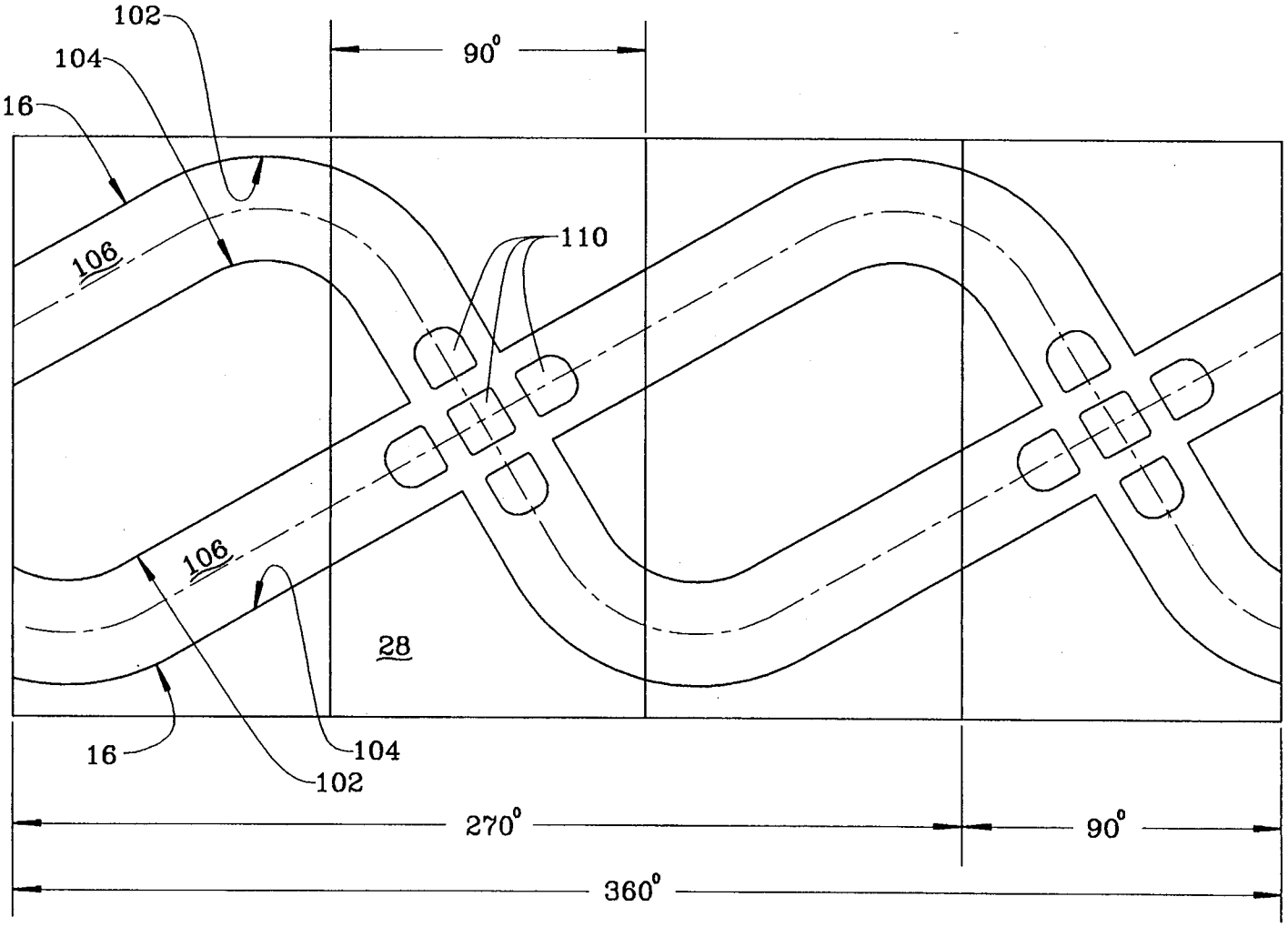
FIG. 4 is a development of a skirt of a piston used in the internal combustion rotary piston engine.

Referring to FIG. 4 it can be seen that each endless track 16 formed in the skirt 28 is in the form of a rectangular section channel having opposing side walls 102, 104 and a bottom wall 106. Each track 16 is sinusoidal in development. The track engaging elements 18 are received in respective tracks 16 at diametrically opposed locations. Each element 18 includes a bearing 108 for rolling contact with the side walls 102, 104 of corresponding track 16. Each element 18 is fixed with respect to the housing 4 so that cooperation between elements 18 and the corresponding tracks 16 cause the piston to rotate about axis 14 upon axial movement along the shaft 10. Furthermore, as the piston 8 is fixed for rotation with the shaft 10 the rotation of the piston 8 causes corresponding rotation of the shaft 10 about axis 14.

Each track 16 comprises one sinusoidal cycle which has the effect of causing the piston 8 to rotate 360° during one complete cycle of the engine 2. The tracks 16 are configured so that during a power stroke of the engine the piston 8 rotates through 270°, and during a return stroke the piston rotates through 90°.

At the locations where the tracks 16 intersect, guides in the form of protrusions 110 extending from bottom walls 106 are provided to ensure that each element 18 remains in its respective track. The protrusions 110 pass between spaced apart legs 112 extending from one side of roller 108 toward the bottom wall 106.

A cam 114 (refer FIGS. 1, 2 and 3) is coaxially mounted on the shaft 10 in the first chamber 20. The cam 114 operates the solenoid valve 64 and an exhaust valve 116. The exhaust valve 116 opens and closes an exhaust port 118 formed in the first chamber 20. A cam follower 120 is biased into contact with the cam 114 by means of a coil spring 122. The cam follower 120 in turn operates an electric switch 124 for selectively energising and de-energising the solenoid valve 64, and a rocker arm 126 which operates the exhaust valve 116. The cam 114 and cam follower 120 cooperate so as to open both solenoid valve 64 and exhaust valve 116 simultaneously. This allows compressed air from storage chamber 50 to flow into the first chamber 20 and out through exhaust port 118 to assist in clearing combusted fuel from the cylinder 6. This flow of air also aids in cooling of the engine 2.

The engine 2 further incorporates a lubrication system which also serves to assist cooling. The lubrication system (refer FIG. 2) comprises a central axial passage 101 formed within the shaft 10. An end of the shaft 10 near the fly wheel 140 is provided with a number of openings 103 which communicate with a cavity 105 formed in the housing 4. The cavity is sealed on one side by sealing ring 107 and on the opposite side by sealing ring 109 adjacent bearing 12. A similar arrangement of openings, cavities and sealing rings are provided at the other end of the shaft 10. The shaft 10 is also provided with a number of transversely extending small bleed holes 111. The lubricating system also includes an oil reservoir (not shown), an oil cooler (not shown) and a pipe (not shown) providing a series connection from cavity 105 through the oil reservoir and cooler to a similar cavity formed near the other end of the shaft 10. This forms a continuous loop for the circulation of lubricating oil within the passageway 101. Oil is conveyed along the passageway 101 by centrifugal force as the shaft 10 rotates. Oil is also able to lubricate the piston 8 by passing through bleed holes 111 and lubricate the bearing 12 by passing through openings 103. Movement of the oil through passage 101 also assists in extracting heat from the engine and pistons. Thus, in effect, the rotating shaft act as an oil pump.

The engine 2 further comprises a second piston 8' of identical construction to piston 8. In particular, piston 8' includes first and second heads 24', 26', which are spaced apart by a skirt 28' depending from the first head 24'. The first head 24' reciprocates in the first chamber 20 and second head 26' reciprocates in a third chamber 22' of the cylinder 6.

The second piston 8' is mounted on the shaft 10 in exactly the same manner as piston 8. Moreover, pistons 8 and 8' are arranged so as to slide along the shaft 10 in mutually opposite directions and to rotate in the same direction during a complete cycle of the engine 2.

The first chamber 20 functions as a combustion chamber of the engine 2. Spark plugs 138 communicate with the combustion chamber for igniting a combustion gas within the combustion chamber.

Water jackets 200 are provided about the housing 4 to assist in cooling the engine 2.

The operation of the above embodiment of the engine 2 will now be described with particular reference to piston 8. However, it is to be understood that the operation of the end of engine 2 incorporating piston 8' is identical.

The engine 2 is operated on a two stroke cycle. The first stroke is a power stroke in which fuel in the chamber 20 is ignited and forces the piston 8 away from cam 114, and a second or return stroke in which combusted fuel is exhausted and a fresh charge of fuel is inducted into the chamber 20. During the power stroke piston 8 moves from top dead centre towards bottom dead centre (position shown in FIG. 1) and fresh air is inducted into the chamber 40 through air intake manifold 72, one way valve 74, and air intake conduit 76. Simultaneously, a fuel and air mixture in chamber 42 is compressed by the second head 26. During the return stroke (shown in FIG. 2) the fuel and air mixture is inducted into the subspace 42 through fuel intake manifold 78 and one way valve 80. Simultaneously, fresh air previously inducted into the chamber 40 is compressed by the second head 26 and enters the storage chamber 50 through one way valve 52 which is now open.

When the piston 8 is at bottom dead centre (illustrated in FIG. 1) cam 114 forces the cam follower 120 upwardly against the bias of coil spring 122. The cam follower 120 then operates electric switch 124 to open the solenoid valve 64 and the rocker arm 126 to open the exhaust valve 116. At or near bottom dead centre, passageway 56 registers with passageway 60 and passageway 66 registers with cut-out 68. Therefore, compressed air in chamber 50 can flow into the combustion chamber 20 through conduit 62 to assist in exhausting combusted fuel through exhaust port 118.

The second head 26 also operates the valve 84 to open the outlet 82 allowing the passage of compressed fuel and air from subspace 42 into the conduit 88. However the fuel is prevented from entering the chamber 20 as passageway 90 is presently closed by the first head 24.

As the cycle of operation continues the piston 8 begins to travel on its return stroke toward the cam 114 and is caused to rotate by virtue of the operation of the tracks 16 and track engaging elements 18. During the rotation of the piston 8 the second cut-out 92 is brought into registration with the passageway 90. This allows the compressed fuel residing in the conduit 88 to enter the chamber 20. Also at this point in time the cam 114 is rotated about the axis 14 allowing the cam follower 120 to be forced by spring 122 toward axis 14 so as to release rocker arm 126 and cause the exhaust valve 116 to close the exhaust port 118.

During continued motion of the piston in the return stroke the fuel and mixture in chamber 20 is further compressed between pistons 8 and 8'. As described above, during this motion of the piston, fuel and air is drawn into the subspace 42 and fresh air within subspace 40 is compressed and forced into the storage chamber 50 through one way valve 52.

When the piston 8 reaches top dead centre (illustrated in FIG. 2) a substantial volume of the air originally inducted into the subspace 40 has been compressed and forced into the storage space 50. However, a small volume of air flows into the space between the skirt 28 and the circumferential surface 32 of the cylinder 6 up to an end of the first head 24 opposite the top surface 70. This air provides additional cooling to the engine 2. It is to be noted that the air in the space cannot return to the second chamber 22 through conduits 62 or 88 as valves 64 and 84 are closed. During the period shortly before or after reaching the top dead centre, sparks are created in the combustion chamber between the pistons 8 and 8' by the spark plugs 138. This ignites the fuel and air mixture within this space driving the pistons 8 and 8' apart, axially along the shaft 10 away from the cam 114. As the piston 8 is driven in this direction it is also caused to rotate by virtue of the cooperation between the track engaging elements 18 and the tracks 16. The rotation of the piston 8 causes corresponding rotation of the shaft 10 about the axis 14 and thereby imparts torque to the shaft 10. The torque imparted to the shaft drives a fly wheel 140 connected to an end of the shaft 10.

As the piston 8 moves towards bottom dead centre during its power stroke the fuel and air mixture in the second subspace 42 is compressed by the second head 26. Simultaneously, air is drawn into the first subspace 40 through air intake manifold 72, one way valve 74 and air intake conduit 76. The one way valve 52 is closed preventing air from entering the storage chamber 50.

After reaching bottom dead centre the piston 8 is returned toward top dead centre by energy stored in the fly wheel 140 which rotates shaft 10 and consequently rotates the piston 8. Due to the configuration of the tracks 16 and the engagement of the tracks 16 with the engaging elements 18 the piston 8 is rotated about axis 14 as it travels axially along shaft 10 towards top dead centre. It is to be understood that this occurs without a change in direction of rotation of the shaft 10 or piston 8.

Figure 5:
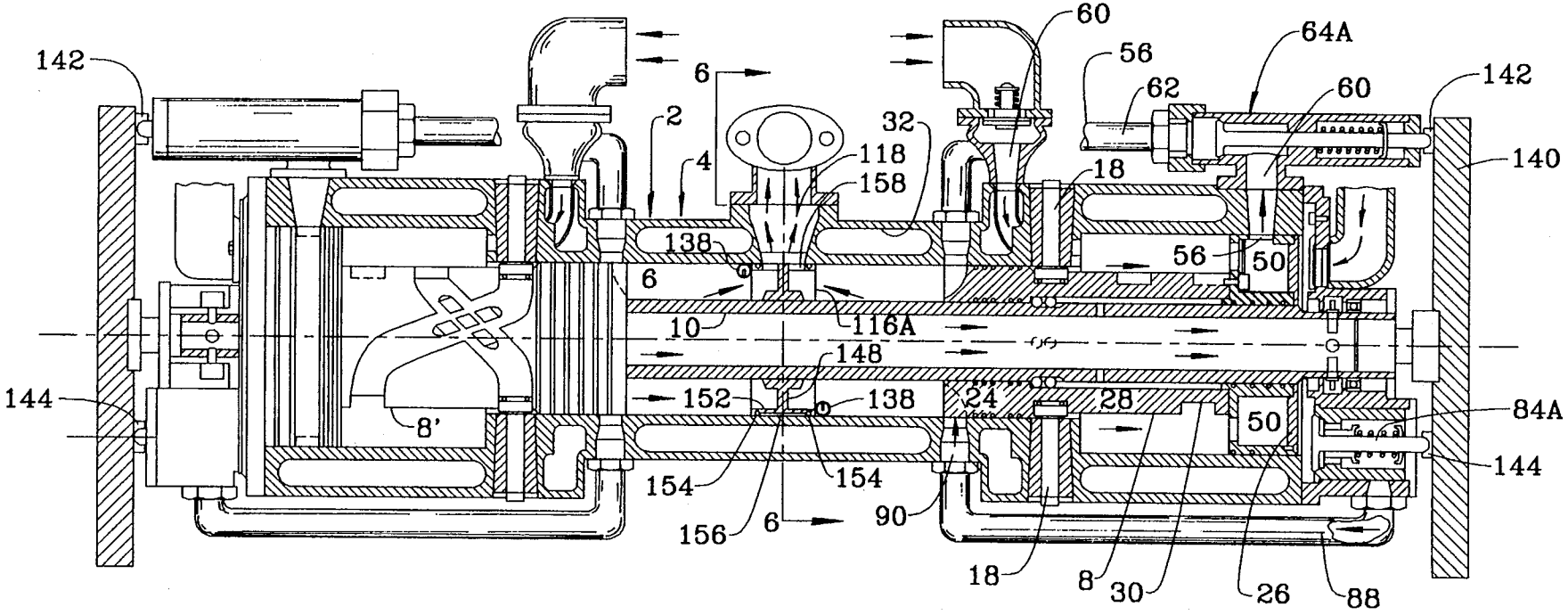
FIGS. 5 is a sectional view of a second embodiment of the internal combustion rotary piston engine at the end of a first stroke.

A second embodiment of the engine is illustrated in FIG. 5 in which like reference numbers denote identical features. There are three main differences between the first and second embodiments. The solenoid valve 64 of the first embodiment is replaced with a spring operated valve 64A which is operated by a cam surface 142 on the fly wheel 140. The spring valve 84 which in the first embodiment is operated by the second head 26 is replaced with spring valve 84A which is operated by a cam surface 144 on the fly wheel 140. Finally, the exhaust valve 116 and associated cam 114, cam follower 120, and rocker arm 126 are replaced by a rotary exhaust valve 116A.

The cam surfaces 142, 144 can be formed as separate arcuate elements that can be demountably connected to the fly wheel 140. In this way the timing of the valves 64A and 84A can be easily varied by attaching cam elements of predetermined lengths and profiles to the fly wheel 140.

Figure 6:
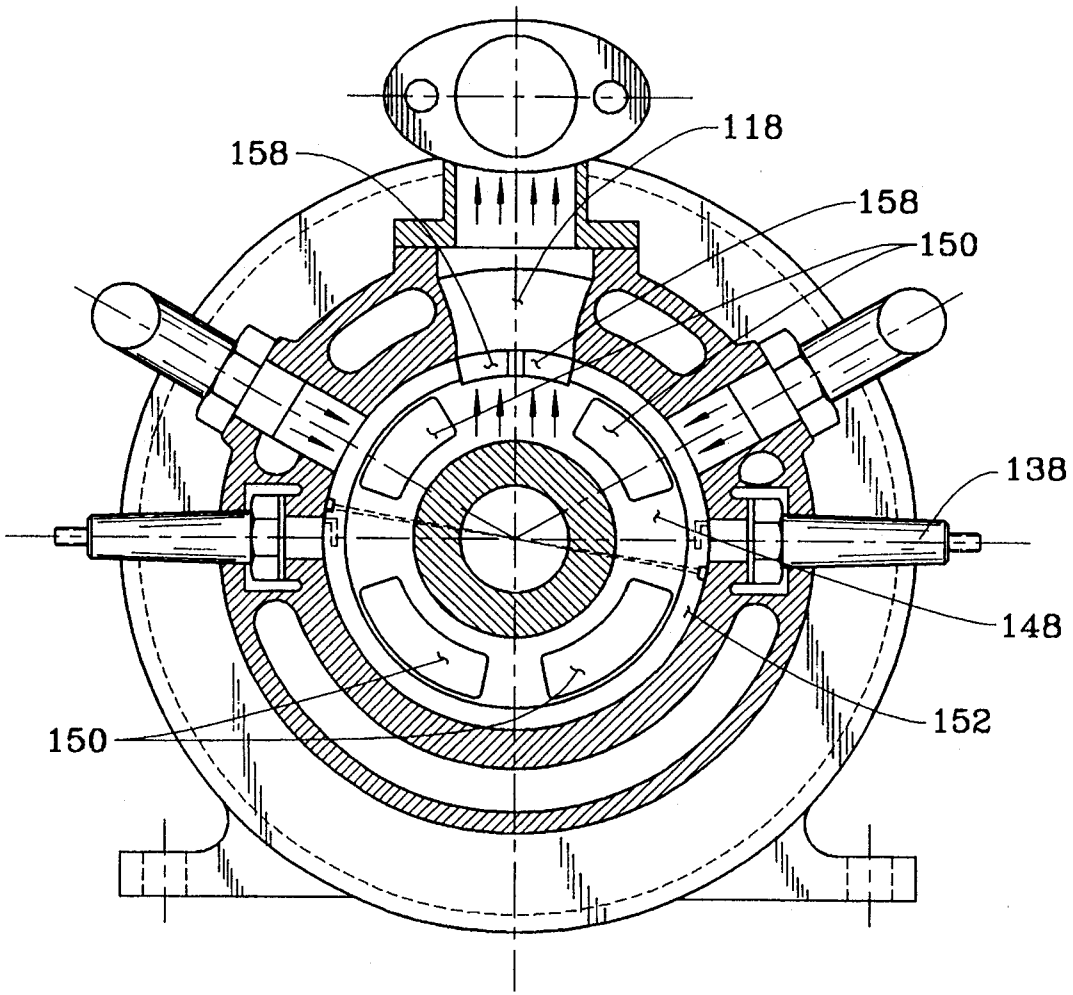
FIG. 6 is a cross section view along section 6—6 of FIG. 5.

The rotary valve 116A comprises an annular plate 148 (refer FIG. 6) coaxially connected to the shaft 10 and extending radially thereof. A plurality of apertures 150 is formed in a plate 148 to allow the free flow of gases between opposite sides of the plate 148. The annular plate 148 terminates in a cylindrical flange 152 having a longitudinal axis coaxial with axis 14. Sealing rings 154 are provided in surface 156 of the flange 152 adjacent the circumferential wall 32 of the cylinder 6. The rings 154 create a seal between the walls 156 and 32. An aperture 158 is formed in the flange 152. The aperture 158 registers with exhaust port 118 once during each complete rotation of shaft 10 about axis 14. During this period gases within the chamber 20 can be exhausted through the aperture 158 and exhaust port 118.

Figure 3:
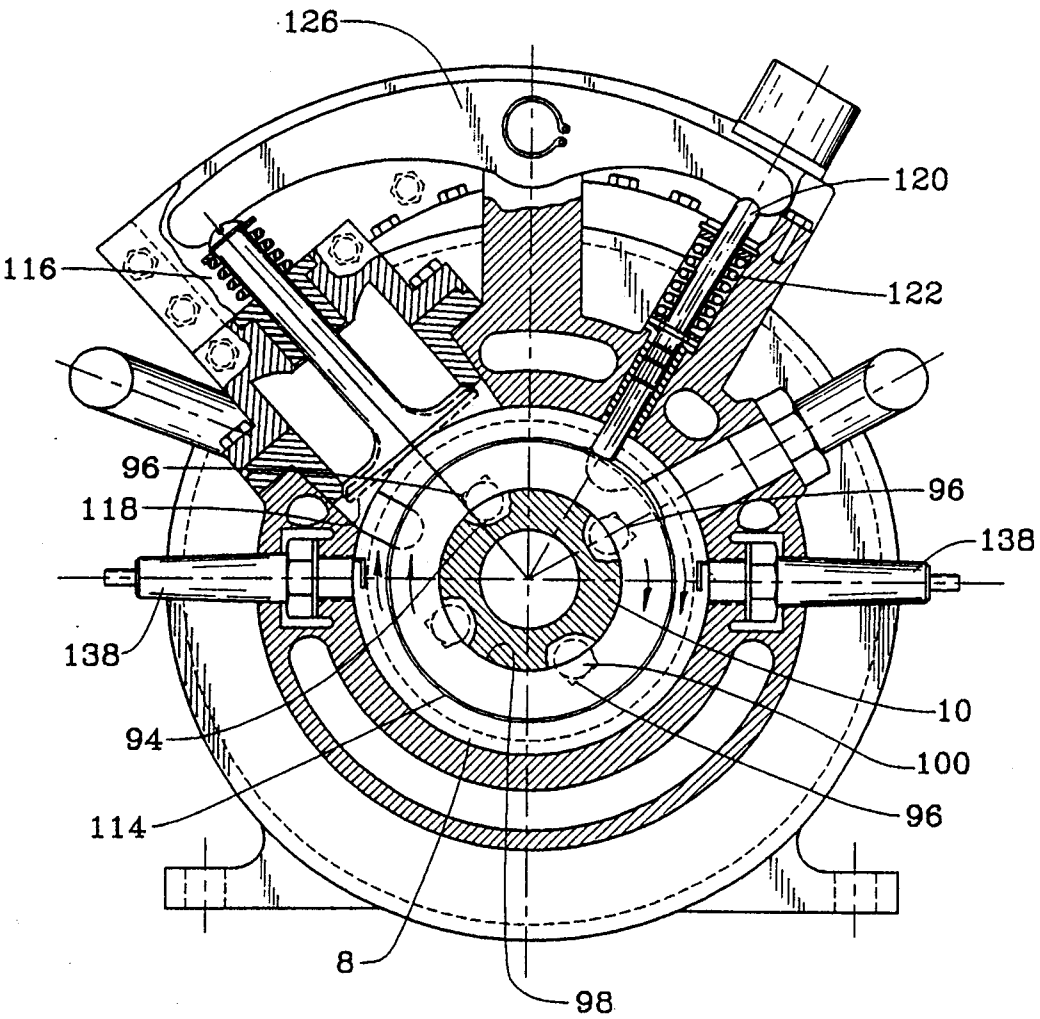
FIG. 3 is a cross sectional view along Section 3—3 of FIG. 1.

In all other respects the working of engine 2 illustrated in FIG. 5 is identical to that of the first embodiment illustrated in FIGS. 1, 2 and 3.

Figure 7:
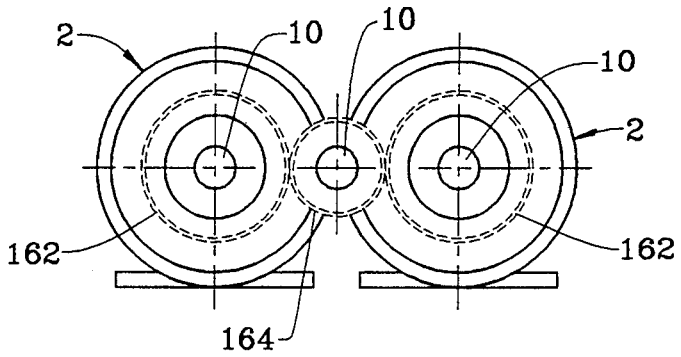
FIG. 7 is an end view of an engine incorporating two of the internal combustion rotary piston engines of FIGS. 1 or 5.
Figure 8:
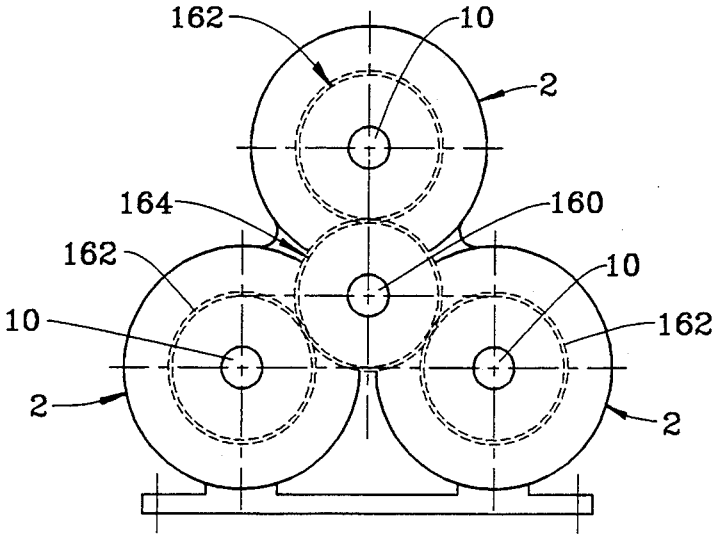
FIG. 8 is an end view of an engine incorporating three of the internal combustion rotary piston engines of FIGS. 1 or 5; and, FIG. 9 is an end view of an engine incorporating four of the internal combustion rotary piston engines of FIGS. 1 or 5.
Figure 9:
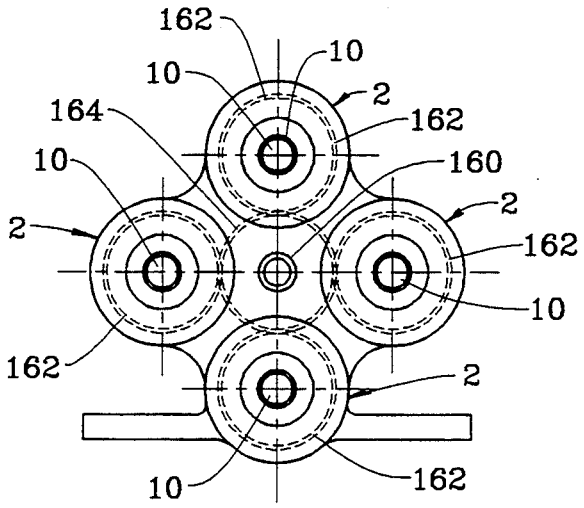

As illustrated in FIGS. 7, 8 and 9, several engines 2 according to the invention can be coupled to a common output shaft 160 for combining the power output of the engines 2. The coupling of the engines 2 to the common output shaft 160 can be readily achieved by connecting a gear 162 to the respective shafts 10 of each engine 2 and disposing the engines 2 about the common output shaft 160 in a manner so that each gear 162 meshes with a gear 164 attached to the output shaft 160.

Theoretical calculations have shown that for an engine 2 having a displacement of 1870 cubic centimeters the power output of 190 hp to 195 hp at 5000 rpm.

It will be readily apparent that the above described embodiments have numerous advantages over conventional two stroke and four stroke engines. Significantly, the power stroke of each piston results in a 270° rotation of the shaft 10 and energy is only required from the fly wheel 140 to rotate the shaft 10 through a further 90° to return the piston to top dead centre. This provides numerous advantages over conventional piston engines where a crank shaft is rotated through 180° in the power stroke and utilises energy from a fly wheel to rotate through a further 180° in a return stroke. The extended duration of the power stroke in the present embodiments is more efficient as it allows torque to be imparted to the fly wheel for a greater period of the cycle of the engine and allows increased burning time to reduce the percentages of noxious exhaust fumes such as carbon monoxide, carbon dioxide, as well as unburnt fuel.

It will be noted that in a conventional two stroke engine the combusted fuel is swept out of the cylinder through an exhaust port by an incoming fresh charge of fuel and air. Accordingly, a portion of the fresh charge can be lost through the exhaust port. Also a portion of the combusted fuel remains in the cylinder and is mixed with the fresh charge. However, both of these problems are substantially overcome by the present embodiments because compressed fresh air is used to purge or sweep clean the combustion chamber before the next fresh charge of fuel and air is admitted into the combustion chamber. Thus, substantially none of the fresh charge is exhausted and substantially no exhaust gases are mixed with the fresh charge.

Furthermore, the forces imparted on the pistons are substantially axial so that there is no significant side thrust on the piston as occurs with conventional reciprocating piston engines. Due to the nature of the connection between each piston and the housing, the momentum gained by the piston in its power stroke is used to assist movement of the piston in its return stroke. The benefit of the momentum is not lost when the piston changes direction of linear travel as occurs with conventional piston engines. Furthermore, the rotating pistons function as fly wheels to conserve momentum of the shaft 10 which in turn allows for the use of smaller fly wheels as would otherwise be the case.

The displacement of the engine 2 is dependent on the difference between the volume of the cylinder 6 and the diameter of the shaft 10. Thus by simply replacing shaft 10 with another shaft of smaller or greater diameter the displacement can be correspondingly increased or decreased.

Now that embodiments of the invention have been described in detail it will be apparent to those skilled in the relevant arts that numerous modifications and variations may be made without departing from the basic inventive concept.

For example, in the present embodiment, the engines 2 are shown as being normally aspirated, that is, fuel and air pre-mixed prior to entering the combustion chamber 20. However, engine 2 can also be operated with a fuel injection system in which fuel is injected into the combustion chamber 20 separate from compressed air.

Although two cylinders 8 and 8' as shown in the embodiments, the engine 2 can of course operate with a single piston only. Furthermore, the cylinder 6 may be divided into two separate cylinders by a transverse wall extending between pistons 8 and 8'. In this arrangement, there would be two combustion chambers one associated with each piston. In an alternative arrangement with the cylinder 6 divided by a transverse wall, the pistons 8 and 8' can be arranged in a "push-pull" manner where, as one piston is in the power stroke of its cycle the other is in the return stoke, and visa versa.

Furthermore, although piston 8 is described as rotating through 270° in the power stroke and at 90° in return stroke the actual degree of rotation can be varied for different applications. It is preferable however that the degree of rotation of the piston in the power stroke be greater than that during the return stroke.

The endless tracks 16 can be made to have sectional profiles other than rectangular. For example, the tracks 16 can be in the form of a triangular or semi-circular sectional channel, or a channel having opposite side walls diverging from a common bottom wall. Furthermore, the profile of the tracks 16 may vary at or near the points of intersection. Moreover, each track 16 may have a different profile.

As an alternative to storing compressed air in storage chamber 50 in the second head 26, a separate storage chamber can be provided outside the cylinder 6. In this arrangement, air inducted into the second chamber 40 during the power stroke can be forced to and compressed in the separate storage chamber outside the cylinder 6 through a port in the second chamber 40 during the return stroke. An outlet of the separate storage chamber can communicate with valve 64 to allow passage of compressed air into the first chamber 20 in the same manner as described above with reference to storage chamber 50.

All such modifications and variations are deemed to be within the scope of the present invention, the nature of which is to be determined from the foregoing description and the appended claims.

I claim:

1. An internal combustion rotary piston engine comprising:

a housing defining a cylinder;

a shaft supported coaxially in said cylinder for rotation about a longitudinal axis of said shaft;

a piston mounted for reciprocation in said cylinder and arranged to slidably move along a length of the shaft during an operating cycle of said engine, said operating cycle comprising a power stroke in which said piston slides in one direction along said shaft and during which a fuel is combusted, and a return stroke in which said piston slides in an opposite direction along said shaft and during which combusted fuel is exhausted; and, means for constraining said piston to rotate about said axis during said sliding movement along said shaft and wherein said shaft is adapted to rotate with said piston about said axis;

wherein said means for constraining controls said piston motion such that during said power stroke said piston rotates about said axis by an angle X°, where X° is greater than 180° and less than 360° and during said return stroke said piston rotates through an angle Y°, where Y° equals 360° minus X°, whereby, in use, during said power stroke said piston imparts torque to said shaft.

2. An engine according to claim 1, wherein X is greater than or equal to 270° and less than 360°.

3. An engine according to claim 2, wherein X is in the order of 270°.

4. An engine according to claim 1, wherein said cylinder comprises first and second chambers and said piston, during one complete cycle of reciprocation of said piston, operates to sequentially induct cleaning fluid into said second chamber, and compress said cleaning fluid for purging said first chamber.

5. An engine according to claim 4, wherein the displacement of said second chamber is equal to or greater than that of the first chamber.

6. An engine according to claim 4, wherein during said piston cycle said piston further operates to sequentially induct a combustion fluid into said second chamber and compress said combustion fluid for combustion in said first chamber.

7. An engine according to claim 4, wherein said piston comprises a first head for reciprocation and rotation in said first chamber and a second head for reciprocation and rotation in said second chamber, said second head operable to induct said cleaning fluid and combustion fluid into said second chamber.

8. An engine according to claim 7, wherein said cleaning fluid and said combustion fluid are inducted into said second chamber on opposite sides of said second head.

9. An engine according to claim 7, further comprising a rotary storage chamber for storing a volume of cleaning fluid compressed by said second head, said storage chamber being in communication with said second chamber.

10. An engine according to claim 9, wherein said storage chamber is formed in said second head and includes a first valve for allowing ingress of the cleaning fluid as said second head compresses said cleaning fluid, and a second valve for allowing egress of said compressed fluid from said storage chamber.

11. An engine according to claim 10, wherein said second valve comprises a first passage formed in said storage chamber and opening onto a circumferential surface of said cylinder, and a second passage formed in said housing and able to communicate with said first chamber, wherein, said first and second passages are arranged to register with each other for a first predetermined period in said piston cycle.

12. An engine according to claim 11, further including a third valve comprising:

a third passage adapted to communicate between said second passage and said first chamber, said third passage opening onto said circumferential surface of said cylinder; and, said first head;

wherein, said first head is arranged to open said third passage during said first predetermined period.

13. An engine according to claim 12, wherein said first head is provided with a first cut-out extending between a circumferential surface of the first head and top surface of the first head, wherein, said first cut-out is arranged to register with said third passageway during said first predetermined period to allow said compressed cleaning fluid to flow into said first chamber.

14. An engine according to claim 13, wherein the delivery of said compressed combustion fluid from said second chamber to said first chamber is effected by a fourth valve comprising:

a fourth passage formed in said cylinder communicating between said first and second chambers, and, said first head;

wherein, said first head is arranged to open said fourth passage during a second predetermined period of said piston cycle occurring after the first predetermined period.

15. An engine according to claim 14, wherein said first head is provided with a second cut-out extending between said circumferential surface of said first head and said top surface of said first head and circumferentially spaced from said first cut-out, wherein, said second cut-out is arranged to register with said fourth passage during said second predetermined period.

16. An engine according to claim 1, wherein said constraining means comprises an endless track provided on one of said piston and said cylinder extending about said axis, and an element mounted on the other of said piston and said cylinder for engaging said track.

17. An engine according to claim 16, wherein said track is formed on said piston and said element is releasably mounted to said cylinder in a manner so that it can be removed from said engine from a location exterior of said housing.

18. An engine according to claim 17, wherein said element comprises a bearing locatable within said track for rolling contact with side walls of said track.

19. An engine according to claim 1, wherein said constraining means comprises an endless track provided on said piston and an element having a bearing for engaging said track, said element releasably connected to said cylinder in a manner so that it can be removed from said engine from a location exterior of said housing.

20. An engine according to claim 1, wherein said constraining means comprises:

first and second endless tracks provided on one of said piston and said cylinder extending about said axis, said first and second tracks arranged to cross at an intersection;

first and second elements mounted on the other of said piston and said cylinder for engaging said first and second tracks respectively; and, guiding means for guiding said elements so they traverse said intersection to re-engage their respective tracks.

21. An engine according to claim 20, wherein each element comprises a roller bearing for rolling contact with the side walls of its respective track and a slide bearing for sliding between said guiding means as said element traverses said intersection.

22. An engine according to claim 21 wherein said tracks are formed on said piston and said elements are releasably mounted to said cylinder in a manner so that they can be removed from the engine from a location exterior of said housing.

23. An engine according to claim 1, further comprising a rotary exhaust valve for exhausting said combusted fuel, said rotary exhaust valve including a cylindrical element mounted co-axially on the shaft with an aperture formed through the circumferential surface of the cylindrical element, whereby, in use, said aperture overlaps an exhaust port formed in the cylinder for a period of time during said return stroke thereby allowing said combusted fuel to flow through the aperture and exhaust port to be exhausted from the engine.

24. An engine according to claim 1, further comprising a second piston slidably mounted for reciprocation in said cylinder and arranged to slidably move along a second length of said shaft during the operating cycle of said engine; and, second means for constraining said second piston to rotate about said axis during said sliding movement along said shaft and wherein said shaft is adapted to rotate with said second piston about said axis, said pistons being arranged to slide along said shaft in mutually opposite directions and to rotate in the same direction during the operating cycle of said engine.

25. An engine according to claim 24, wherein said cylinder comprises a third chamber, and said second piston comprises a first head for reciprocation and rotation in said first chamber and a second head for reciprocation and rotation in said third chamber, wherein said first and second pistons reciprocate and rotate in synchronism.

26. An engine according to claim 25, wherein the displacement of said third chamber is equal or greater than that of said first chamber.

27. An engine according to claim 1, wherein said shaft includes an axial passage for flow of a lubricating fluid therethrough for lubrication and cooling of said engine.

28. An engine according to claim 27, wherein said shaft, when it rotates about said axis, acts as a pump for circulating said lubricating fluid through said engine.

29. An engine according to claim 4, wherein said cleaning fluid acts to internally cool said engine by transferring heat Generated by said engine from between said piston and said cylinder to the external atmosphere.

30. An engine according to claim 29, wherein said piston is shaped so that, as it moves toward the top of said first stroke, a passage is formed between a length of said piston and a circumferential surface of said first chamber and wherein a volume of said cleaning fluid can flow into said passage to cool said engine.

* * * * *